United States Patent [19]

Tamaki et al.

[11] 4,448,871

[45] May 15, 1984

[54] TONER FOR DEVELOPING AN ELECTROSTATICALLY CHARGED IMAGE AND MANUFACTURING METHOD THEREOF

[75] Inventors: Kiyoshi Tamaki; Hideki Murata; Sadatugu Terada; Tsuneo Wada, all of Hino; Akitoshi Matsubara; Hiroyuki Takagiwa, both of Hachioji, all of Japan

[73] Assignee: Konishiroku Photo Industry Co., Ltd., Tokyo, Japan

[21] Appl. No.: 295,657

[22] Filed: Aug. 24, 1981

[30] Foreign Application Priority Data

Aug. 27, 1980 [JP] Japan ..... 55-118825

[51] Int. Cl.[3] ..... G03G 9/08

[52] U.S. Cl. ..... 430/109; 430/137

[58] Field of Search ..... 430/109, 137; 260/42.53, 42.43

[56] References Cited

U.S. PATENT DOCUMENTS 4,231,919 11/1980 Isaacson ..... 430/137

*Primary Examiner*—John E. Kittle

*Assistant Examiner*—John L. Goodrow

*Attorney, Agent, or Firm*—Jordan B. Bierman; Linda Bierman

[57] ABSTRACT

A process for manufacturing towers and their use in developing an electrostatically charged image comprising polymerized grains formed by the suspension polymerization of an alpha-beta unsaturated polymeric monomer or monomers in the presence of a dispersion stabilizer selected from the group consisting of aluminum hydroxide, ferric hydroxide titanium hydroxide and thorium hydroxide.

2 Claims, No Drawings

TONER FOR DEVELOPING AN ELECTROSTATICALLY CHARGED IMAGE AND MANUFACTURING METHOD THEREOF

The present invention relates to toners for developing an electrostatically charged image, and more particularly to the toners for developing an electrostatically charged image having a high image density and having been improved in developability and humidity resistance thereof.

Generally in an image forming process in electrophotography, a photoconductive layer, that is a photosensitive substance, is uniformly charged by making use of a corona charging means and a light image based on an original drawing is illuminated on said photoconductive layer by means of an exposure means, and electric charge of the illuminated area of said layer is reduced or extinugished and an imagelike electrostatic latent image is formed on the photoconductive layer, and said electrostatic latent image is visualized by developers of which principal component is toners, and thus a toner image is formed.

The said toner image is to be recorded as a permanent image as it is, or to be transferred onto a copying material such as an image transfer paper and then to be fixed as a permanent image.

As for the development processes by making use of said toner developer, a dry type development process and a wet type development process are given, and accordingly the developers to be used for the above processes are classified into a dry type developer and a wet type developer, and said dry type developers comprise the toners obtained by mixing carriers such as thermoplastic resins or soluble resins with coloring agents such as dyes and pigments, and said wet type developers are also known as the liquid type developers and comprise the materials having dispersed coloring agents such as dyes and pigments into a liquid having dissolved carriers such as resins therein.

Conventionally, a dry type toner has so far been manufactured in a general process, wherein pigments such as carbon black are fusedly mixed in thermoplastic resins and prepared as a uniform disparsant and then pulverized by means of a finely pulverizing means to obtain fine grains having the grain diameter necessary for the use thereof as toners.

However, in the toner manufacturing processes as mentioned above, the processes such as fusing and pulverizing are required therein, therefore it is demanded therein, for example, to become in the state that some material with which toners are to be manufactured, can be fluidized at a suitable temperature and that pigments and the like can be uniformly mixed, and also demanded that the desirable grain diameter can be obtained by means of a device for the use of pulvelization of said mixture, at a fairly high speed, so that the above mentioned manufacturing processes have the shortcoming that materials thereto are subject to restriction on the usage.

In addition, in the case of using an easily pulvelizable material on the other hand, said materials are apt to be pulverized further in an electrophotographic copying equipment, so that they will also cause stains in the equipment, and will cause image-fogs, that is another shortcoming derived from the materials. And, in the case of using an only easily fusible material, there are also the possibilities of a toner caking and a toner filming on photoconductive layer surface.

Further, if pigments having been buried in resins appear on a surface when they are pulverized, there is the possibility to cause a partial ununiformity of frictional charge characteristics, or it may be considered that there is the possibility to cause the trouble on the humidity resistance of the materials when some kind of pigments is used.

The matter calling into question other than the aforementioned problems, is that the configurations of the toners manufactured by pulverization is irregular. It may be considered that this fact will be apt to cause the cohesions of toners with each other and will undesirably affect toner stability in storage, toner dispensation property in supplying, and besides the sharpness of a developed image and cleaning property in the repeating use, and thus the fact affects seriously the copy images obtained actually, particularly resolution power, sharpness, fog, etc., and thus has become the undesirable problem.

With respect to the manufacture of toners in the above-mentioned pulverization processes, for example, Japanese Patent Examined Publication Nos. 10231/1961, 10799/1968 and 14895/1976 have disclosed the processes for manufacturing toners in the so-called polymerization process. These processes can remedy the shortcomings of toners manufactured in the aforesaid pulverization processes.

Then, in order that the polymeric grains having the enough grain diameter necessary for serving as toners, can be manufactured directly in a dispersive polymerization process such as a suspension polymerization process, it is required that polymeric composites are dispersed in a dispersion medium stably in the shape of fine grains having the enough grain diameter necessary for the purpose so that those grains may not be united with each other and may not become larger grains.

In the suspension polymerization processes of monomers, water or water dispersion medium is used as to the dispersion medium therein, and normally, a dispersing agent is contained in a dispersion medium for the purpose of obtaining a stable dispersed state of polymeric composites. Generally, said dispersing agents are roughly classified into water-soluble high molecular substance and hardly water-soluble inorganic fine powders, and as for the substances belonging to the former, gelatin, starch, polyvinyl alcohol, carboxymethyl cellulose, etc. are known, and as for the substances belonging to the latter, the fine powders of hardly water-soluble salts such as barium sulfate, calcium sulfate, barium carbonate, calcium carbonate and magnesium carbonate, and the fine powders of inorganic high molecular substances such as tarc, clay silicic acid and diatom earth, and the fine powders of metals oxide such as aluminium oxide and titanium oxide, are known.

However, in the conventional processes, the following shortcomings are found therein: dispersing agent having been contained in a dispersion medium absorbes or adheres on the grain surfaces of polymeric composites having been dispersed, and prevents the grains from uniting with each other, so that said dispersing agents can be contained within the obtained polymeric grains, and it is very difficult to remove the dispersing agents having once been contained in said polymeric grains. Consequently, said grains are to be disturbed in the suitable characteristics thereof to serve as the desirable toners by the dispersing agents having been contained.

For example, said dispersing agents are hydrophilic generally, and by said hydrophilic property thereof, toners are to easily be absorbable for moisture and are to be cohered during the storage, and thus the inconveniences such as no display of an excellent developability will be caused.

An object of the present invention is to provide the toners for developing an electrostatically charged image having the improved developability and moisture absorption, and a high imageability, particularly a high image density, and is also to provide the manufacturing process thereof.

As the result of making studies, the present inventors have achieved the aforesaid object by providing toners for developing an electrostatically charged image containing polymers prepared by making polymeric monomers suspension-polymerize, in the presence of dispersion stabilizer having $\zeta$ electric potential at 20 mV or higher and anionic surface active agent.

Accordingly, in the present invention, metals oxide having $\zeta$ electric potential at 20 mV or higher described in "Progr. Colloid & Polymer Sci.,", vol. 63, pp. 41 to 49, 1978, for example, is used for a dispersion stabilizer, and said dispersion stabilizer and anionic surface active agent are contained in a water dispersion medium, and a coloring agent and polymeric monomers, or other additives for providing toner characteristics if occasion demands, are added and then dispersively suspended, and thus obtained polymeric composites are polymerized to prepare polymerized grains, and when thus prepared polymerized grains are processed with dilute acid, the dispersion stabilizer having been contained in the polymerized grains becomes water-soluble, therefore said dispersants can be removed by washing, and thus, the toners for developing an electrostatically charged image of the invention can be prepared.

Herein, the term, "theta electric potential" means an electric potential (viz., an electrokinetic potential) to be generated on a glide plane when a relative motion is motivated in the tangential direction against an electric double layer to be formed on the phase boundary between a solid and liquid or between two kinds of liquids.

As for the dispersion stabilizers having the theta electric potential at 20 mV or higher, preferably at 20 mV or higher and 100 mV or lower which are to be used in the invention, aluminium hydroxide, ferric hydroxide, titanium hydroxide, thorium hydroxide and the like are given as the example thereof, however, the said dispersion stabilizers for the invention are not limited to the specific examples given above.

The aforesaid dispersion stabilizers of the invention are easily removed from polymeric grains through a dilute acid process and then by washing as aforementioned, therefore, it has completely solved the problems of the humidity dependence and developability which have so far been caused due to the remaining dispersion stabilizers within polymeric grains, and thus it has been successful to provide the toners having the stable image characteristics.

And, anionic surface active agents to be used together with the aforesaid dispersion stabilizers are to accelerate the desired functions of said dispersion stabilizers, and can be given by the concrete examples such as sodium dodecylbenzene sulfonate, sodium tetradecyl sulfate, sodium pentadecyl sulfate, sodium octyl sulfate, sodium allyl-alkyl-polyether sulfonate, sodium oleinate, sodium laurate, sodium caprate, sodium caprylate, sodium caproate, potassium stearate, calcium oleinate, sodium 3,3'-disulfondiphenylurea-4,4'-diazo-bis-amino-8-naphthol-6-sulfonate, ortho-carboxybenzene-azo-dimethylaniline, sodium 2,2',5,5'-tetramethyl-triphenylmethane-4,4'-diazo-bis-$\beta$-naphthol-disulfonate, and the like.

The amount of the aforesaid dispersion stabilizers to be used in the invention is within the range between approx 0.01–10% by weight against the amount used of monomers, and the amount used therein of the aforesaid anionic surface active agents is within the range between 0.001–0.10% by weight against the amount use of the aforesaid dispersion medium. And, in order to dispersively suspend a polymerized composite in a dispersion medium, it is necessary to agitate a system, and the agitation may be made by means of a homomixer, a homomixer or the like, and the revolution rate thereof is normally within the range between 1,000–6,000 r.p.m., and when a polymerized composite is devided once into grains having the desired grain diameter, then the state thereof can almost be kept as it is by the actions of said dispersion stabilizers, therefore the agitation of grains may be done enough to the degree at the utmost so as to prevent the grain from sedimenting. The polymerization temperature is normally within the range of 50° C.–120° C., and a uniform polymerization may be performed at the lower temperature within the range.

In the invention, among the concrete examples of the polymeric monomers to be used for preparing the polymerized grains of toners, as to $\alpha$-$\beta$ unsaturated monomers, styrenes and the derivatives thereof are given such as styrene, o-methylstyrene, m-methylstyrene, p-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorstyrene, and 3,4-dichlorstyrene; among of which styrene monomers are the most preferable. As for the other vinyl monomers, there can be given the following examples thereof: ethylene monoolefin unsaturated such as ethylene, propylene, butylene and isobutylene; vinyl halide such as vinyl chloride, vinylidene chloride, vinyl bromide and vinyl fluoride; vinyl ester such as vinyl acetate, vinyl propionate, vinyl benzoate and vinyl butyrate; $\alpha$-methylene aliphatic monocarboxylic acid ester such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chlorethyl acrylate, phenyl acrylate, $\alpha$-methyl chloracrylate, methyl methacrylate, ethyl methacrylate, propyl methacrylate, n-butyl methacrylate, isobutyl methacrylate, n-octyl methacrylate, dodecyl methacrylate, 2-ethylhexyl-methacrylate, stearyl methacrylate, phenyl methacrylate, dimethylaminoethyl methacrylate and diethylaminoethyl methacrylate; acrylic acid such as acrylonitrile, methacrylonitrile and acrylamide, or methacrylic acid derivatives; vinyl ether such as vinyl methylether, vinyl ethylether and vinyl isobutylether; vinyl ketone such as vinyl methyl ketone, vinyl hexyl ketone and methyl isopropenyl ketone; N-vinyl compounds such as N-vinyl pyrrole, N-vinyl carbazole, N-vinyl indole and N-vinyl pyrolidone; and vinyl naphthalenes.

The toners of the invention are prepared by polymerizing said monomers in a suspension polymerization process in the presence of a dispersion stabilizer and an anionic surface active agent. Therefore, vinyl monomers are desirable to serve as the polymeric monomers to be used in the invention.

In polymerizing the polymers relating to the invention, any arbitrary polymerization initiator, particularly an oil soluble polymerization initiator is used at the normal temperature range. The concrete examples of polymerization initiators are given benzoyl peroxide, lauryl peroxide, 2,2'-azobis isobutylonitrile, 2,2'-azobis-(2,4-dimethyl valeronitrile), benzoyl orthochlor peroxide and benzoyl orthomethoxy peroxide. As for the polymerization processes, the processes performing under no pressure or pressurized atomosphere are adopted. And, during a polymerizing process of said monomers, coloring agents and other additives for providing toner characteristics such as an electric charge controlling agent and a fluidizing agent can be added therein, and when the polymerization was completed, thus obtained polymers can be processed to prepare the grains so that they can be used as toners as they are, and after completed the polymerization of said monomers, toners can be manufactured by mixedly kneading, cooling and pulverizing coloring agents and the like.

The molecular weight of the aggregation relating to the invention is arbitrary, however, preferably 50,000–1,000,000, particularly 50,000–200,000.

In polymerizing, the polymers relating to the invention can be prepared as cross-linking polymers by the polymerization in the presence of cross-linking agents. As for the cross-linking agents to be preferably used, there are mainly given the compounds having two or more polymeric double linkage. For example, the following compounds are selected independently or as a mixture: aromatic divinyl compounds such as divinyl benzene, divinyl naphthalene and the derivatives thereof, and for the other examples, diethylene ester cabonate such as ethylene glycol dimethacrylate, diethylene glycol methacrylate, triethylene glycol methacrylate, trimethylolpropane triacrylate, allyl methacrylate, t-butyl aminoethyl methacrylate and 1,3-butane diol dimethacrylate; every divinyl compound such as N,N-divinyl aniline, divinyl ether, divinyl sulfide or divinyl sulfone; and any compound having three or more vinyl groups. Furthermore, the following are to be used as the cross-linking agents in the invetion: dihydric alcohols such as ethylene glycol, triethylene glycol, 1,2-propylene glycol, 1,3-propylene glycol, 1,4-butane diol, neopentyl glycol, 1,4-butene diol, 1,4-bis(hydroxymethyl)cyclohexane, bis-phenol A, hydrogen added bisphenol A, and polyoxy propylenized bisphenol A; dihydric acids and the derivatives thereof such as maleic acid, fumaric acid, mesaconic acid, citraconic acid, itaconic acid, glutaconic acid, phthalic acid, isophthalic acid, terephthalic acid, cyclohexane dicarboxylic acid, succinic acid, adipic acid, sebacic acid malonic acid, the anhydrides thereof or esters of lower alcohols thereof; trihydric or more polyhydric alcohols such as glycerol, trimethyl propane and pentaerythritol; and, trihydric or more polyhydric carboxylic acids such as trimellitic acid and pyromellitic acid.

As for the amount added of the aforesaid cross-linking agents into monomers is chosen from an amount thereof within the range between 0.005–20% by weight, preferably between 0.1–5% by weight. If the said amount was in excess in use, said cross-linking agents become insoluble, so that thus obtained polymers are apt to lose the fixability necessary for serving as toners. And, if the said amount was too short, the characteristics such as durability, reservability and anti-abrasiveness, which are included in the characteristics of toners, can hardly be endowed toners, and particularly in a heat roller fixing type copying machine or the like, it becomes hard to display the functional effects that a cross-linking action can widen the molecular weight distributions of polymers and consequently the property of toners in themselves can prevent developments from causing an offset.

Also the toners of the invention can hold low molecular weight olefin polymers which have been known as surface lubricant. Said low molecular weight olefin polymers may be held in the course of a monomer polymerization process together with carbon black to be used in the invention, or may be used in a pulverizing process, etc. after polymers have been obtained, however, in the case of the invention, it is desirable to hold them in the process of polymerization.

The low molecular weight olefin polymers to be used as toners of the invention, are the olefin polymers containing olefin only as a component of monomer or the olefin copolymers containing monomers other than olefin as a component of monomer, either of which are of low moleculars. Olefins for a component of each monomer includes every olefin, for example, ethylene, propylene, butene-1, pentene-1, hexene-1, heptene-1, octene-1, bunene-1, decene-1 or the homologues thereof in which the position of unsaturated coupling is defferent therefrom, or, for example, 3-methyl-1-butene, 3-methyl-2-pentene, 3-propyl-5-methyl-2-hexene and the homologues thereof into which alkyl group is induced as a branched chain.

And, other than olefin, the monomers to serve as a component of monomer forming copolymers, together with olefins, a variety of monomers can be given, for example, vinyl ethers such as vinyl methyl ether, vinyl-n-butyl ether, and vinyl phenyl ether; vinyl esters such as vinyl acetate and vinyl butylate; halolefins such as vinyl fluoride, vinylidene fluoride, tetrafluoroethylene, vinyl chloride, vinylidene chloride and tetrachloroethylene; esters acrylate or esters methacrylate such as methyl acrylate, ethyl acrylate, n-butyl acrylate, methyl methacrylate, ethyl methacrylate, n-butyl methacrylate, stearyl methacrylate, N,N-dimethylaminoethyl methacrylate and t-butylaminoethyl methacrylate; acrylic type derivatives such as acrylonitrile and N,N-dimethyl acrylamide; and organic acids such as acrylic acid, methacrylic acid, maleic acid, fumaric acid and itaconic acid, diethyl fumarate; and $\beta$-pinene.

The low molecular weight olefin polymers of the invention include the olefin polymers composing of only olefins containing at least two kinds of olefins as described above, as a component of monomer, such as ethylene-propylene copolymer, ethylene-butene copolymer, ethylene-pentene copolymer, propylene-butene copolymer, propylene-pentene copolymer, ethylene-3-methyl-1-butene copolymer and ethylene-propylene-butene copolymer; or olefin copolymers containing both at least one kind of olefins as described above and at least one kind of monomers other than the olefins as described above, as a component of monomer such as ethylene-vinyl acetate copolymer, ethylene-vinyl methyl ether copolymer, ethylene-vinyl chloride copolymer, ethylene-methacrylate copolymer, ethylene-methylacrylate copolymer, ethylene-acrylic acid copolymer, propylene-vinyl acetate copolymer, propylene-vinyl ethyl ether copolymer, propylene-ethyl acrylate copolymer, propylene-methacrylic acid copolymer, butene-vinyl methyl methacrylate copolymer, pentene-vinyl acetate copolymer, hexene-vinyl butylate copolymer, ethylenepropylene-vinyl acetate copolymer, and ethylene-vinyl acetate-vinyl methyl ether copolymer.

Among the low molecular weight olefin polymers relating to the invention, the desirable ones containing the other types of monomers than olefin as a component of monomers, are to have the olefin components in copolymers as many as possible. The reason is that, generally speaking, the less olefin components contain, the worse the surface lubricity is, and there is also the tendency to worsen the toner characteristics such as fluidity and imageability. Accordingly, it is desirable that the amount contained of olefin components in each copolymer is as much as possible, and in the invention, the low molecular weight olefin polymer having an approx. more than 50 mol% of olefin component is effectively used therein.

The molecular weight of the low molecular weight olefin polymer of the invention may be made good if included in the range of low molecular weight having been generalized in the normal high molecular compounds, and may normally be 1,000–45,000 in weight average value of molecular weight (Mw), preferably 2,000–6,000.

As for the low molecular weight olefin polymers, it is preferable to have the softening points thereof at 100°–180° C., particularly at 130°–160° C.

The amount used of the low molecular weight olefin polymers of the invention are 1–20 parts by weight per 100 parts by weight of the resin components of toners, preferably 3–15 parts by weight thereof, and if the amount used thereof is less than one part by weight, there are some instances where a satisfactory offset prevention effect cannot be obtained, or, if said amount is more than 20 parts by weight, it is undesirable because there may be some instances where gellations cause in the process of polymerization.

For the purpose of improving toners of the invention in the fixation performance such as offset prevention effect, prepolymers (inter alia, reactive prepolymers) can be added in the process of polymerization. The reactive prepolymers to be used for the above purpose, are to have reactive groups in the principal chain and/or the side chain thereof, and as to the said reactive groups, carboxy group, sulfo group, epoxy group, ethyleneimino group, isocyanate group, double coupling, acids anhydrous and the like can be given as the examples thereof.

The typical prepolymer compound examples are given as follows:

[As for the compounds having epoxy group]

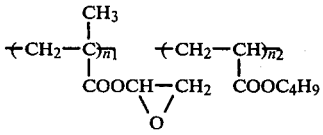

(1)

($n_1$:$n_2$ = 10:90)

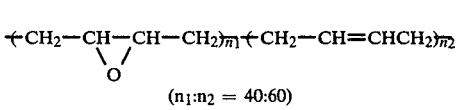

(2)

($n_1$:$n_2$ = 40:60)

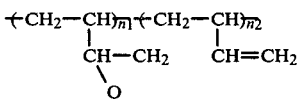

(3)

($n_1$:$n_2$ = 30:70)

-continued

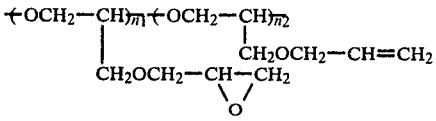

(4)

($n_1$:$n_2$ = 50:50)

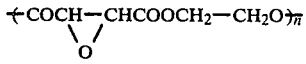

(5)

[As for the compounds having ethyleneimino group]

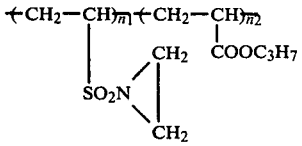

(6)

($n_1$:$n_2$ = 30:70)

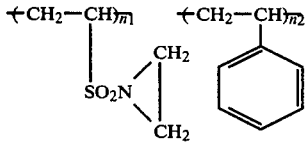

(7)

($n_1$:$n_2$ = 60:40)

[As for the compound having isocyanate group]

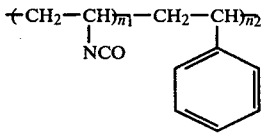

(8)

($n_1$:$n_2$ = 20:80)

[As for the compounds having double coupling]

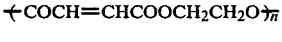

(9)

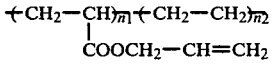

(10)

($n_1$:$n_2$ = 60:40)

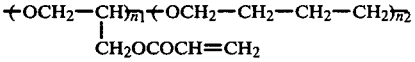

(11)

($n_1$:$n_2$ = 50:50)

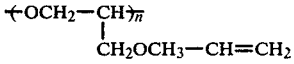

(12)

[As for the compounds having acid anhydrous]

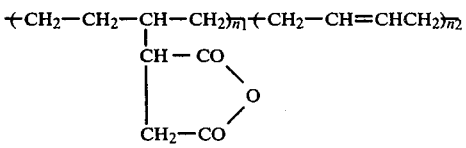

(13)

($n_1$:$n_2$ = 60:40)

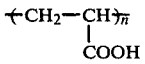

(14)

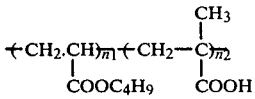

(15)

($n_1$:$n_2$ = 30:70)

-continued

[As for the compounds having sulfo group]

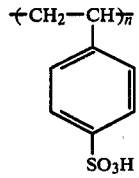

(16)

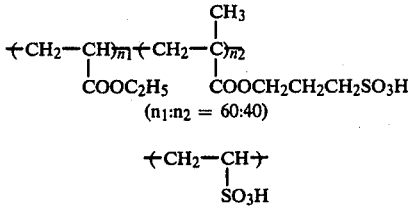

(17)

$(n_1:n_2 = 60:40)$ (18)

[As for the compounds cross-coupling through the light]

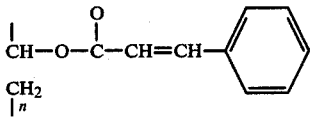

(19)

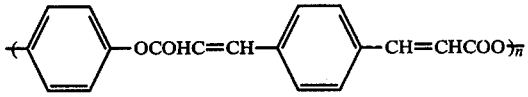

(20)

Besides the above, butadiene prepolymers can also be used as the prepolymers for the purpose.

The prepolymers having the wide range of molecular weight are used, and the range of the molecular weights in weight average is between 1,000 and 500,000. The amount used is normally 5–95 parts by weight to 100 parts by weight of polymeric monomers.

In the present invention, low molecular weight olefin polymers may also be added in an arbitrary manufacturing process of the toners of the invention.

In the case that a zerographic copying is required, the toners to be used therein may also be comprised of black pigments such as carbon black or black dyes such as amablust black dyes. It is desirable that said pigments are to be used in the amount of approx. 3–20% by weight to the whole weight of toners having been colored.

Also, in the invention, there can be used the magnetic coloring agents useful for the toners to be used for single component developers.

As for the desirable magnetic coloring agents for the above purpose, there are desirably given the substances which are ferromagnetized in the direction of a magnetic field, in black, and stable chemically to be dispersed well in resins, and further among those of which the coloring agents having fine grain diameter of 1μ or smaller are desirable, particularly magnetite (triiron tetraoxide) is most preferable. As for the typical magnetic or magnetizable materials, the following materials can be used for: metals such as cobalt, iron and nickel; metallic alloys and the mixtures thereof such as aluminum, cobalt, steel, lead, magnesium, nickel, tin, zinc, antimony, beryllium, bismuth, cadmium, calcium, manganese, selenium, titanium, tangsten and vanadium; metallic compounds including metals oxide such as aluminium oxide, iron oxide, copper oxide, nickel oxide, zinc oxide, titanium oxide and magnesium oxide; nitrides having fire resistance such as vanadium nitride and chrome nitride; carbides such as tungsten carbide and silica carbide; and ferrite and the mixtures thereof. The amount of said ferromagnetic substance to be contained in toners is desirably approx. 50–300 parts by weight to 100 parts by weight of resin components. Particularly, 70–200 parts by weight thereof to 100 parts by weight of resin components are desirably to be contained.

Among the obtained polymers of the invention, every polymer having the softening point at 100°–170° C. measured by a ring and ball method is particularly affective to serve as the resins for toner use, and the ones having the glass transition point at approx. 40°–110° C. are effective. In other words, if a softening point thereof is lower than 100° C., said polymers are pulverized or a toner filming phenomenon is caused and thus a photosensitive plate having photoconductivity is apt to be contaminated, and if a softening point thereof is beyond 120° C., pulverization thereof is difficult because the toners are hard, and also a high calory is required when fixing and thus the fixing efficiency becomes worse.

On the other hand, if a glass transition point is lower than 40° C., a lump formation is apt to be caused by a cold flow phenomenon because the storage conditions of toners are normally at lower than 40° C., and if a glass transition point is beyond 110° C., but apart from the case that a fixing roller material is of metal, there is a limit in heat resistance of a roller material, so that it is impossible to raise said roller temperature so high, particularly in the case of fixing at a high speed, there is the shortcoming that a satisfactory fixation cannot be made, for example, a fixing roller which is made of Teflon (mfd. by Du Pont) is apt to be worn out or to start the decomposition thereof at the said roller temperature of higher than 250° C.

With respect to the polymers of the invention obtained as described above, it is preferable that they are the fine grain toners to be used practically as they are, but either the toners are manufactured to have the grain diameter of 1–50μ by pulverizing said polymers by means of a pulverizer, for example, by classifying by means of a zig-zag classifier, or the toners are manufactured by mixing said polymers with coloring agent, kneading by means of a kneading mill, cooling and then pulverizing, will also do.

In order that an image can be formed with the toners of the invention in an image forming method such as an electrophotographic method, anyone of the following photosensitive substances is used for: selenium photosensitive substance; a photosensitive substance which was provided on the conductive support thereof with a photosensitive layer, wherein an inorganic photoconductive material such as zinc oxide, cadmium sulfide, cadmium selenide, cadmium sulfur selenide, lead oxide or mercury sulfide, was dispersively contained in the resin binders thereof; or a photosensitive substance which was provided on the conductive support thereof with a photosensitive layer, wherein an organic photoconductive material such as anthracene or polyvinyl carbazole was contained the resin binders if occasion demands. Onto the surface of the photosensitive layer of said photosensitive substance, a charge is applied all over the surface by corona discharging with the aid of a corotron or scorotron charger, for example, and then thus charged surface is exposed imagewise to light on the like and an electrostatically charged image is formed. Next, said electrostatically charged image is developed to form a toner image with a developer comprising, for example, a mixture of the toners of the invention and glass beads or iron powdered carriers, through a process of, for example, cascade process or magnetic brush process. Thus obtained toner image is pressed against an image transfer paper under a corona discharge for example, and transferred thereonto. The toner image thus transferred onto an image transfer paper is then heatedly fixed by a heat roller type fixing device coated with fluorine resins or silicone rubber having surface lubrication property.

As detailedly described above, in the present invention, a specific dispersion stabilizer which can be removed from polymeric grains through a dilute acid process, is dispersed in a water medium, and a monomer composite is suspension-polymerized, and thus the toners of polymerized grains are manufactured, therefore, it has been possible to obtain the superior toners for developing an electrostatically charged image having higher image density, particularly superior humidity resistance and developability in comparison with any conventional type of toners.

The following illustrates the examples of the invention, however it is to be understood that the invention is not limited to the specific embodiments thereof.

EXAMPLE 1

The mixture was made with 70 parts of styrene, 30 parts of n-butyl methacrylate, 0.2 parts of trimethylolpropane triacrylate, 5 parts of carbon black, MA-600, 5 parts of polydiphenyl siloxane, KR-216, and 3 parts of 2,2'-azobis-(2,4-dimethyl valeronitrile) and then satisfactorily mixedly dispersed by making use of a sand stirrer. Next, ferric hydroxide solution of 3.0% by weight and 0.24 parts of NL-R (16.4% solution) both against the amount of said porimeric monomers were mixed, and then the abovesaid dispersant was added in thus obtained mixed solution, while the agitation was made by a TK-Homogenizer at the speed of 5,000 r.p.m. Thereafter, the polymerizing reaction thereof was completed in six hours time at 60° C. by shifting the agitating speed at 100 r.p.m. by means of a normal anchor type agitator. After completed the polymerization, the solid substances thereof were filterated by cooling and then soaked in hydrochloric acid solution of 5% in density, and thereby the ferric hydroxide having acted as a dispersion stabilizer was decomposed, and washing was made until the washing liquid became neutral, and then was dehydrated and dried up, and thus the toners having an average grain diameter of 13μ have been obtained.

EXAMPLE 2

Styrene of 85 parts, 15 parts of n-butyl methacrylate, 5 parts of Mitsubishi Carbon Black #2,300, 5 parts of polydiphenyl siloxane KR-216, 0.2 parts of trimethylolpropane triacrylate and 3 parts of 2,2'-azobis-(2,4-dimethyl valeronitrile) were satisfactorily mixed and dispersed by means of a sand stirrer. Next, the solution of 3.0% by weight of aluminium hydroxide solution and 0.24 parts of NL-R (16.4% solution) was prepared, and the aforementioned dispersant was added and mixed therein with agitating at the agitating speed of 6,000 r.p.m. by making use of a TK-Homogenizer. The toners having an average grain diameter of 12μ have thus been obtained in the similar processes to those in Example 1, except the abovementioned process.

EXAMPLE 3

Styrene of 70 parts, 30 parts of n-butyl acrylate, 5 parts of Mitsubishi Carbon Black #2300, 5 parts of polydiphenyl siloxane KR-216, 0.5 parts of divinyl benzene, and 3 parts of 2,2'-azobis-(2,4-di-methyl valeronitrile) were satisfactorily mixed and dispersed by means of a sand stirrer. Next, the solution of 3.0% by weight of titanium hydroxide solution and 0.24 parts of NL-R (16.4% solution) was prepared, and therein the aforementioned dispersant was added and dispersed with agitating at the agitating speed of 6,000 r.p.m. by making use of a TK-Homogenizer. Thus, the toners having an average grain diameter of 13μ have been obtained in the similar processes to those in Example 1, except the abovementioned process.

EXAMPLE 4

Styrene of 60 parts, 60 parts of n-butyl methacrylate, 100 parts of triiron tetraoxide powders, 0.2 parts of trimethylolpropane triacrylate, 5 parts of carbon black MA-600, 0.5 parts of methylene blue chloride, and 3 parts of azobis isobutylonitrile, were satisfactorily mixed and thus a dispersant was prepared.

Next, the solution of 3.0% by weight of ferro hydroxide solution and 0.25 parts of NL-R (16.4% solution) was prepared, and therein, the abovementioned dispersant was added and dispersed with agitating at the agitating speed of 5,000 r.p.m by making use of a TK-Homogenizer. Thus, the toners having an average grain diameter of 14μ have been obtained in the similar processes to those in Example 1, except the abovementioned process.

COMPARISON EXAMPLE 1

Except that hydrophilic silica "Aerosil" (mfd. by Dexa Co.) having an average grain diameter of 16 mμ was used in the amount of 3% by weight of monomers, in place of ferric hydroxide used in Example 1, quite the same processes with those in Example 1 were applied, and thus the toners having an average grain diameter of 12μ have been obtained.

With respect to the samples having been thus obtained from each examples respectively, values of the respective volume resistivities thereof have been measured, of which results are shown in the following Table 1:

TABLE 1

| Sample | Volume resistivity (.cm) |
|---|---|
| Sample of Example 1 | $1.5 \times 10^{17}$ |
| Sample of Example 2 | $2.0 \times 10^{18}$ |
| Sample of Example 3 | $3.5 \times 10^{18}$ |
| Sample of Comparison Example 1 | $2.0 \times 10^{8}$ |

As is obvious from the above Table 1, anyone of the samples 1–3 prepared in the process of the invention has the satisfactory value of volume resistivity, but in contrast with the above, that of Comparison Example 1 is lower.

Next, copying tests were respectively tried with a U-Bix V copying machine (mfd. by Konishiroku Photo Ind. Co., Ltd.) by making use of each developer respectively prepared by mixing 5 parts each of the samples given in the above Table 1 with 95 parts each of Iron Carriers (mfd. by Dowa Iron Powder Mfg. Co.), and among the tests, in the case that the developers prepared with the samples 1–3 described in the above Table 1 were used, an image having the satisfactory density was able to be formed respectively, particularly in a high speed continuous copying, a high practicality was confirmed, but in contrast with the above, in the case of using the developer prepared with the sample of Comparison Example 1, it has been proved that the image density thereof was low and impossible to practically use for the purpose.

And, with respect to the developer obtained from the sample of Example 4, the copying was tried with a U-Bix T copying machine (mfd. by Konishiroku Photo Ind. Co., Ltd.) by making use of said developer, and therein it has proved that not only the toner density was high and no fog has occurred but also no offset phenomenon has occurred at the time of fixing.

We claim:

1. A toner for developing an electrostatically charged image comprising polymerized grains formed by the suspension polymerization of an alpha-beta unsaturated polymeric monomer or monomers in the presence of a dispersion stabilizer selected from the group consisting of aluminum hydroxide, ferric hydroxide, titanium hydroxide and thorium hydroxide.

2. A process for manufacturing toners for developing an electrostatically charged image comprising suspension polymerizing an alpha-beta unsaturated polymeric monomer or monomers in the presence of an aqueous dispersion of an anionic surface active agent and a dispersion stabilizer selected from the group consisting of aluminum hydroxide, ferric hydroxide, titanium hydroxide and thorium hydroxide.

* * * * *